US009949575B2

(12) United States Patent
Pond et al.

(10) Patent No.: US 9,949,575 B2
(45) Date of Patent: Apr. 24, 2018

(54) CHILD CARRIER

(71) Applicant: UPANAWAY, LLC, Carlsbad, CA (US)

(72) Inventors: Brian Richard Pond, Encinitas, CA (US); Anna Stepanov, San Diego, CA (US)

(73) Assignee: UPANAWAY, LLC, Carlsbad, CA (US)

( * ) Notice: Subject to any disclaimer, the term of this patent is extended or adjusted under 35 U.S.C. 154(b) by 154 days.

(21) Appl. No.: 14/931,192

(22) Filed: Nov. 3, 2015

(65) Prior Publication Data

US 2016/0120334 A1 May 5, 2016

Related U.S. Application Data

(60) Provisional application No. 62/074,571, filed on Nov. 3, 2014.

(51) Int. Cl.
*A61G 1/00* (2006.01)
*A47D 13/02* (2006.01)

(52) U.S. Cl.
CPC ..... *A47D 13/025* (2013.01)

(58) Field of Classification Search
CPC ..... A47D 13/025
USPC ..... 224/160
See application file for complete search history.

(56) References Cited

U.S. PATENT DOCUMENTS 3,327,914 A 6/1967 Abram
4,009,808 A 3/1977 Sharp
4,234,229 A 11/1980 Arnold
4,333,591 A 6/1982 Case
4,434,920 A 3/1984 Moore
4,579,264 A 4/1986 Napolitano
4,986,458 A 1/1991 Linday
5,205,450 A * 4/1993 Derosier ..... A47D 13/025 224/161
5,224,637 A 6/1993 Colombo
5,246,152 A 9/1993 Dotseth
5,570,823 A 11/1996 Lindy
5,673,828 A * 10/1997 Raedel ..... A47D 13/025 224/158
5,678,739 A 10/1997 Darling et al.
5,791,535 A 8/1998 Roan et al.
5,848,741 A * 12/1998 Fair ..... A47C 7/66 224/160
5,934,528 A 8/1999 Higuchi
(Continued)

OTHER PUBLICATIONS http://hipdysplasia.org/developmental-dysplasia-of-the-hip/prevention/baby-carriers-seats-and-other-equipment/.

*Primary Examiner* — Derek Battisti
(74) *Attorney, Agent, or Firm* — Coastal Patent Law Group, P.C.

(57) ABSTRACT

The disclosure concerns a child carrier having a seat platform and a belt assembly adjustment strap each coupled to a belt assembly. The belt assembly adjustment strap is configured to tighten first and second opposing sides of the belt assembly about the waist of the wearer thereby forming a bowed front portion of the belt assembly and a securing the seat platform in a horizontal orientation for supporting the body of the child. The instant child carrier is configured to maintain the body of the carried child in an ergonomically correct position. In addition, the child carrier includes multiple adjustable components for configuring the carrier to a preference of the wearer.

14 Claims, 9 Drawing Sheets

(56) References Cited

U.S. PATENT DOCUMENTS

| | | | | |
|---|---|---|---|---|
| 6,409,060 | B2 * | 6/2002 | Donine | A47D 13/025 224/160 |
| 6,415,969 | B1 * | 7/2002 | Higuchi | A47D 13/025 224/159 |
| 6,443,339 | B1 | 9/2002 | Higuchi | |
| 6,772,925 | B2 | 8/2004 | O'hare | |
| 7,322,498 | B2 * | 1/2008 | Frost | A47D 13/025 224/155 |
| 7,770,765 | B2 * | 8/2010 | Stevens | A47D 13/025 224/158 |
| 8,272,546 | B2 | 9/2012 | Leistensnider | |
| 8,393,505 | B2 | 3/2013 | Coote | |
| 8,590,757 | B2 | 11/2013 | Frost | |
| 8,636,181 | B2 | 1/2014 | Gunter et al. | |
| 9,022,260 | B2 | 5/2015 | Frost | |
| 9,038,868 | B2 | 5/2015 | Poiani | |
| 9,439,516 | B2 * | 9/2016 | Workman | A47D 13/025 |
| 2003/0106916 | A1 | 6/2003 | Boone | |
| 2004/0149790 | A1 * | 8/2004 | Kassai | A47D 13/025 224/160 |
| 2005/0242136 | A1 * | 11/2005 | Moriguchi | A47D 13/025 224/160 |
| 2010/0288803 | A1 | 11/2010 | Reid | |
| 2010/0308087 | A1 | 12/2010 | Lindbloom | |
| 2011/0089205 | A1 | 4/2011 | Coote | |
| 2014/0060453 | A1 | 3/2014 | Shewfelt | |
| 2014/0263491 | A1 * | 9/2014 | Telford | A47D 13/025 224/160 |

* cited by examiner

CHILD CARRIER

CROSS-REFERENCE TO RELATED APPLICATIONS

This application claims benefit of priority with U.S. Provisional Ser. No. 62/074,571, filed Nov. 3, 2014, and titled "CHILD CARRIER"; the contents of which are hereby incorporated by reference.

BACKGROUND

Field of the Invention

This invention relates to child carriers, also called "baby carriers", "infant carriers" and "toddler carriers" that can be worn by an adult with the child being positioned to face toward the wearer or away from the wearer. More particularly, the invention relates to a child carrier including the improvement of an adjustable seat platform, the seat platform being adjustably configurable to ergonomically and safely support the body of the child being carried.

Description of the Related Art

Conventional child carriers, while they are functional, they are not optimally designed for the safety, comfort and health of the child, nor for the ease-of-use and comfort of the caregiver. Furthermore, many carriers are optimally suited for carrying a child in single orientation, either on the front of and with the child facing the caregiver or on the front of and with the child facing away from the caregiver.

One of the difficulties of currently available child carriers is that they are unsafe and difficult to put on and to secure the child. Some carriers require that a wearer let go of the child to attach or tighten buckles that require both hands, which can result in harm to the child.

Examples of conventional child carriers include those described in Frost (U.S. Pat. No. 7,322,498), Gunter et al. (U.S. Pat. No. 8,636,181) and Telford et al. (US 2014/0263491); the contents of each of which are hereby incorporated by reference.

Furthermore, the medical community has identified certain problems with the resulting position of the child being carried by many child carriers, including those carriers as disclosed in Frost, Gunter et al. and Telford et al., above. This position consists of the child dangling from, or being mainly supported by, their crotch. It is said that this type of support can lead to hip problems in the infant being carried, such as developmental dysplasia of the hip, as well as general discomfort. The body or pouch of many carriers attaches directly to the top of the hip belt, resulting in a narrow wedge of space where the child sits, thus squeezing the child's pelvis and causing his or her legs to hang down toward the ground. Additional information regarding child-carrier induced hip dysplasia, and other related problems, can be reviewed at: http://hipdysplasia.org/developmental-dysplasia-of-the-hip/prevention/baby-carriers-seats-and-other-equipment/.

The instant invention seeks to provide an improved child carrier aimed at solving these and other problems in the art.

SUMMARY

A child carrier is disclosed, the child carrier includes: a hip belt, a pouch assembly attached to the hip belt along an upper seam thereof, a body harness attached to the pouch assembly for strapping the child carrier about an adult wearer, with the child carrier further characterized by an adjustable seat platform assembly coupled to the hip belt; the adjustable seat platform assembly including a seat platform attached to the hip belt along the upper seam, and an adjustable seat strap configured to erect the seat platform in accordance with a desired application or use of the child carrier.

DETAILED DESCRIPTION OF EMBODIMENTS

Figure 1:
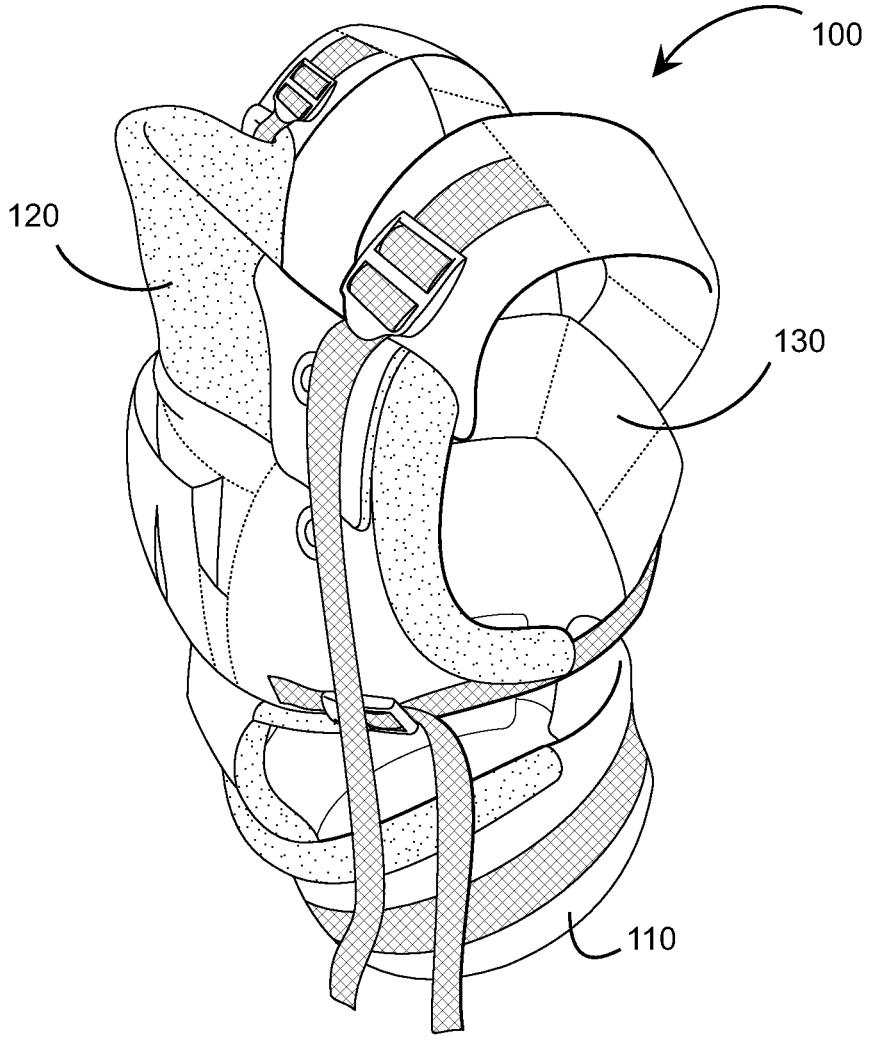
FIG. 1 shows a perspective view of the child carrier in accordance with an illustrated embodiment.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions. The following details and descriptions are intended to illustrate various embodiments of the invention; however, these details and descriptions are not intended to limit the scope of the invention as set forth in the claims.

Now, in a general embodiment, the invention includes a child carrier with a padded hip belt (or "belt assembly") that can be adjusted to fit the caregiver while providing an optimal seat for the child's comfort and well-being, specifically as it relates to the child's hips, bottom and upper legs.

Additionally, in some embodiments, the carrier can include six points of adjustment, including: a first shoulder strap buckle, a second shoulder strap buckle, a first side buckle, a second side buckle, a belt buckle assembly, and the seat buckle, which affords the ability to optimally configure the carrier for the child's comfort and for the desired orientation or position of the child in either inward-facing or outward-facing positions for a variety of different sized caregivers. These adjustment points enable the wearer to easily secure the child in the carrying position without taking a hand off of the child. To achieve this, the top two straps are loosened, allowing the carrier to fall away from the front of the caregiver the child is brought into the desired position, then the straps are tightened with one hand, while the other hand remains on the child.

Additionally, the upper straps may be adjusted to position the carrier on the caregiver for proper fit and general comfort of the child and caregiver (or "wearer").

The belt assembly contains a seat platform that is radially attached along one side to the front, top, inner portion of the hip belt (the "upper seam") on one side and is attached to a strap (or "belt assembly adjustment strap"), which is attached at two points on the inner circumference of the circular belt assembly, the belt assembly adjustment strap can be tightened, causing a portion of the belt to extend away from the caregiver to form a bowed front portion and a seat for the child. The resulting configuration provides a support or platform for the child's bottom and thighs, which is especially important in the face-out position (i.e. with the child facing away from the wearer). This seat platform is adjustable to afford more support for the outward-facing child orientation, and less support for the inward-facing orientation.

In one embodiment, the seat platform can be manufactured to include two layers of polyester fabric that are attached to the upper seam of the belt assembly using strong thread. For purposes of defining the configuration of the seat platform, it is said that a first side of the seat platform is attached to the belt assembly along the upper seam. A channel or "loop" is formed between the two layers; the loop extends along the length of the seat platform along a second side that is opposite the first side. A strip of webbing (or "adjustment strap") runs though this channel or "loop". The adjustment strap is adjustable, and when tightened, results in the desired seat configuration by forming a bowed or bent front portion of the belt assembly. It should be noted that there should be enough rigidity in the belt assembly such that when the belt assembly adjustment strap is tightened, the amount of material beyond the adjustment strap sticks out to form a bowed or bent front portion of the belt assembly thereby providing the desired seat, while the wearer can still tighten the hip belt to secure the carrier and transfer load to the hips.

Now turning to the drawings, wherein an illustrated embodiment is described, FIG. 1 shows a perspective view of the child carrier in accordance with the illustrated embodiment. The child carrier 100 comprises three primary and distinct portions, including: a belt assembly 110; a pouch assembly 120; and a body harness 130. Each of these portions will be further described below. The pouch assembly is attached to the belt assembly at a front side of the child carrier, and the harness is coupled to the pouch assembly using a number of straps and buckles as shown.

Figure 2:
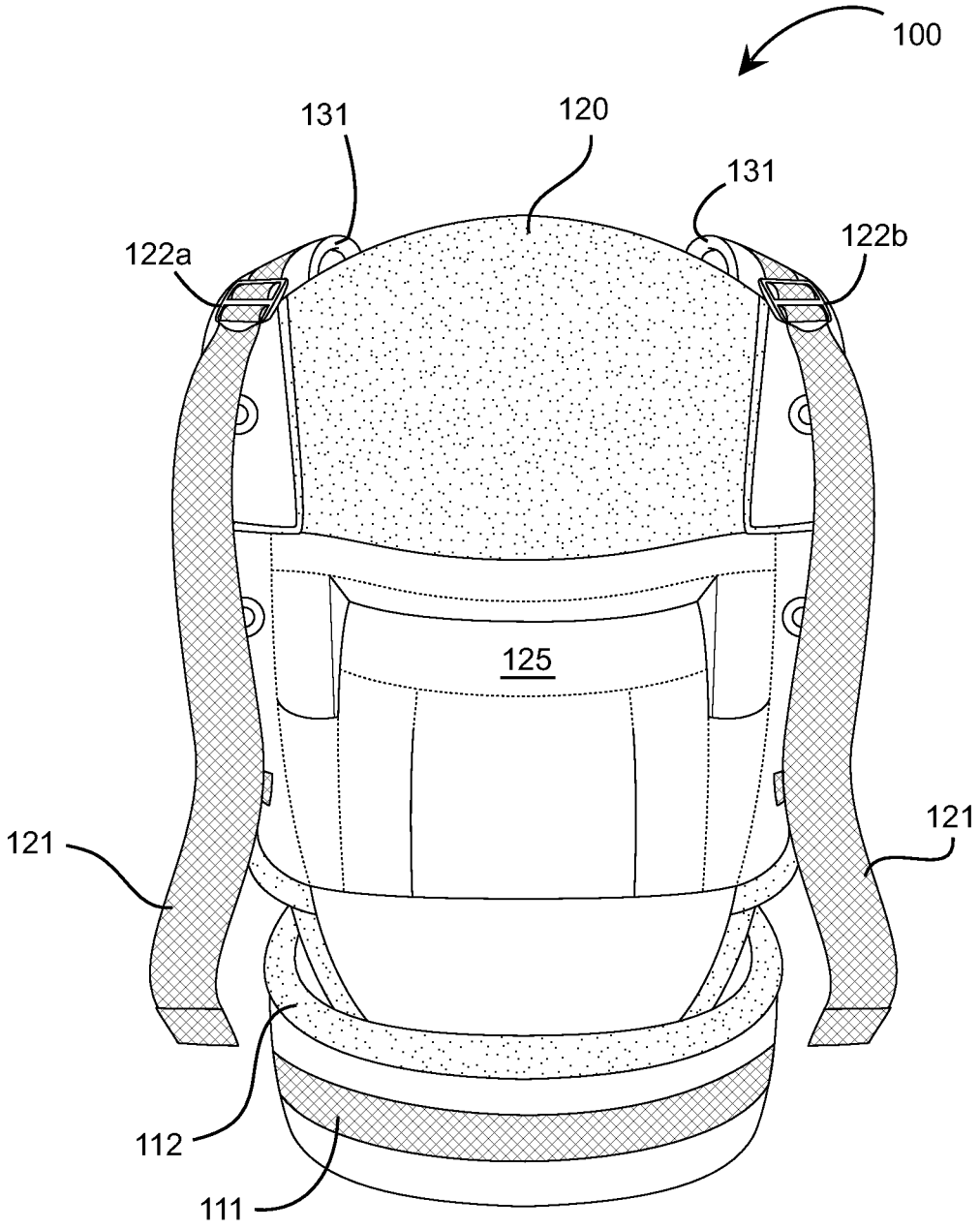
FIG. 2 shows a front view of the child carrier in accordance with the illustrated embodiment.

FIG. 2 shows a front view of the child carrier 100 in accordance with the illustrated embodiment. The belt assembly portion is shown including a belt 111 and a belt pad 112. Attached to an upper circumference of the belt assembly is the pouch assembly 120. The pouch assembly includes a main body portion with an optional pocket 125 and upper straps 121 attached to a main body of the pouch assembly. The shoulder straps include elongated shoulder strap pads 131 and a number of buckles attached to the shoulder straps, such as a first shoulder strap buckle 122*a* and a second shoulder strap buckle 122*b*.

Figure 3:
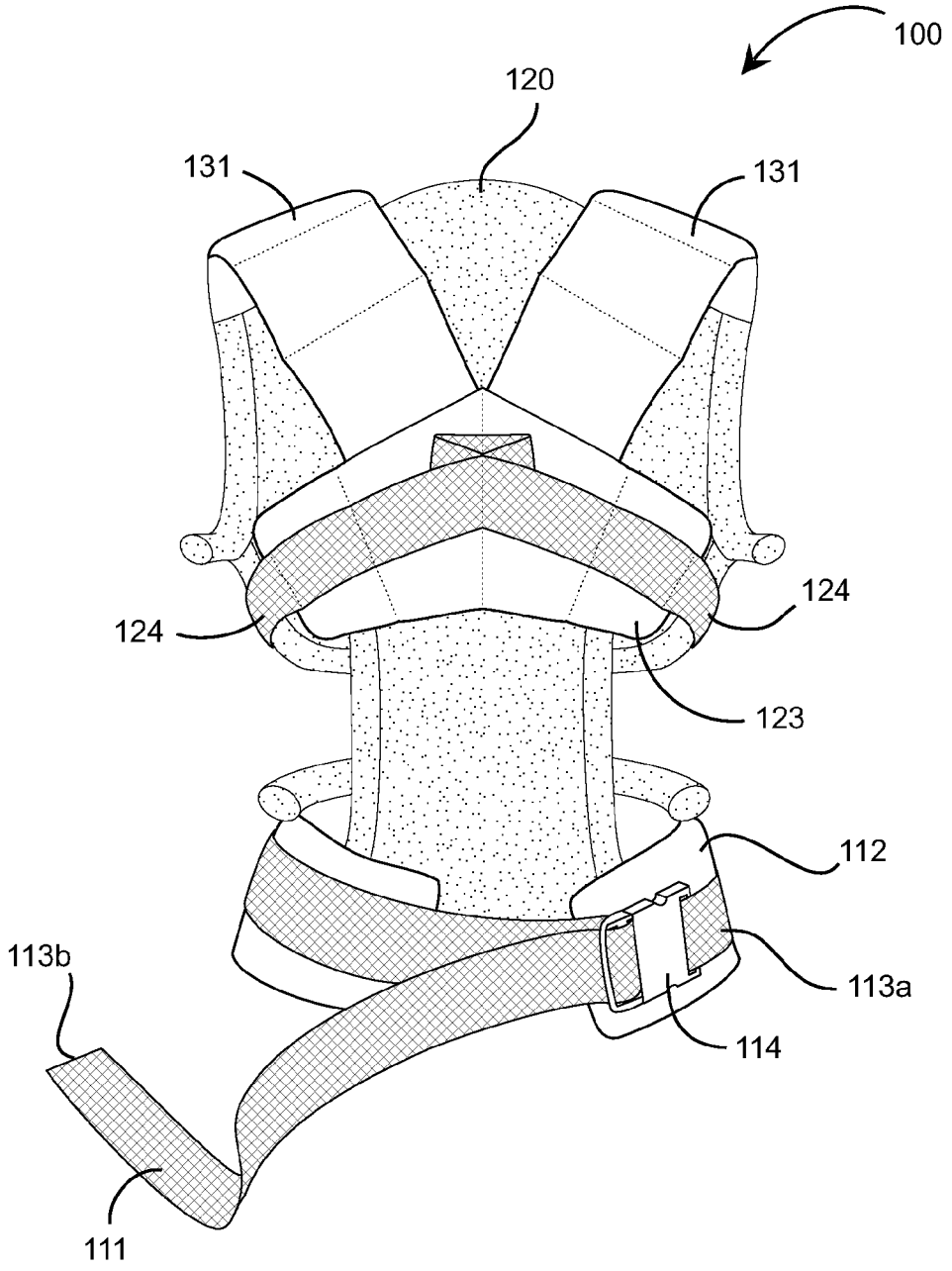
FIG. 3 shows a rear view of the child carrier in accordance with the illustrated embodiment.

FIG. 3 shows a rear view of the child carrier 100 in accordance with the illustrated embodiment. From a rear view, the child carrier is shown comprising a belt assembly including belt 111 coupled to belt pad 112. A belt buckle assembly 114 is fixedly attached to the belt 111 at a first terminal end 113*a*, and further adjustably attached to the belt at a second terminal end 113*b*. The pouch assembly 120 is connected to a body harness including a body strap pad 123 and shoulder pads 131. A body strap 124 is attached to the body strap pad as shown, and extends toward the front of the carrier where the body strap is engaged with corresponding buckles.

Figure 4:
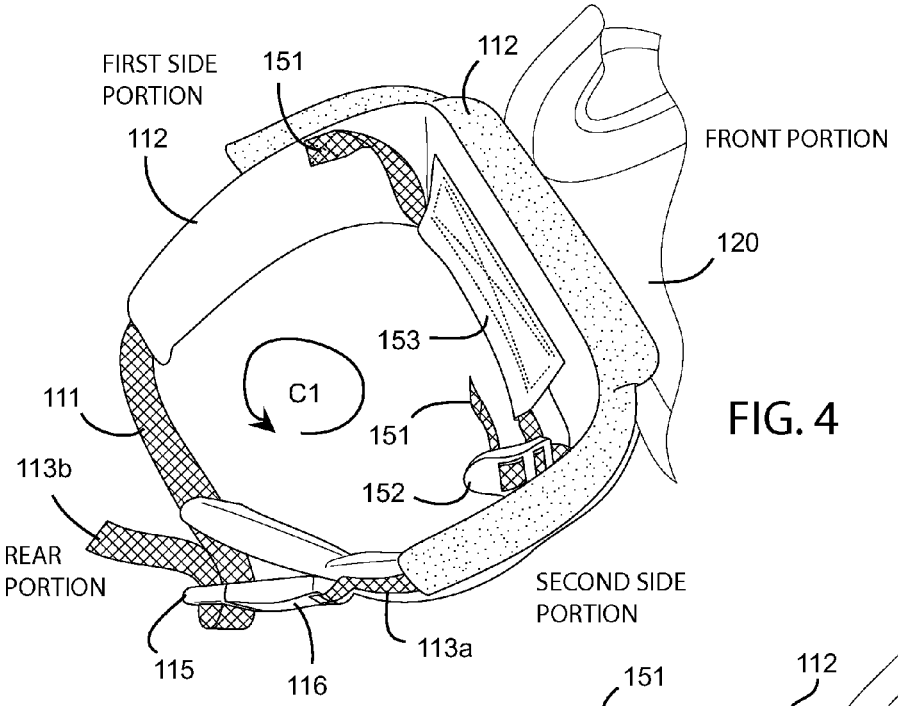
FIG. 4 shows a top view of the belt assembly and seat platform of the child carrier with the seat platform being configured in a rest configuration and hanging downwardly from the upper seam.

FIG. 4 shows a top view of the belt assembly and seat platform 153 of the child carrier with the seat platform being configured in a rest configuration and hanging downwardly from the upper seam. Note that with the belt assembly (belt 111 and belt pad 112) attached at the belt buckle assembly (belt buckle 115 and belt buckle receiver 116), the belt defines an adjustable circumference C1 and can be said to include a front portion, rear portion, first side portion and second side portion as shown and labeled. Perhaps more clearly, the instant figure shows the belt 111 having a first terminal end 113*a* and the belt buckle receiver 116 fixedly coupled to the belt at the first terminal end. Further, the belt 111 includes a belt buckle 115 adjustable coupled to the belt at a second terminal end 113*b*. The pouch assembly 120 is attached to the belt assembly at the front portion. The instant belt assembly is further characterized by a seat platform 153 having a first side attached to the belt assembly and a second side including a loop or channel, wherein a belt assembly adjustment strap 151 is fixedly attached to the belt assembly at the first side portion and extends through the loop of the seat platform toward the second side. The belt assembly adjustment strap 151 is adjustably engaged with seat buckle 152, and the seat buckle is fixedly attached to the belt assembly at the second side portion.

Figure 5:
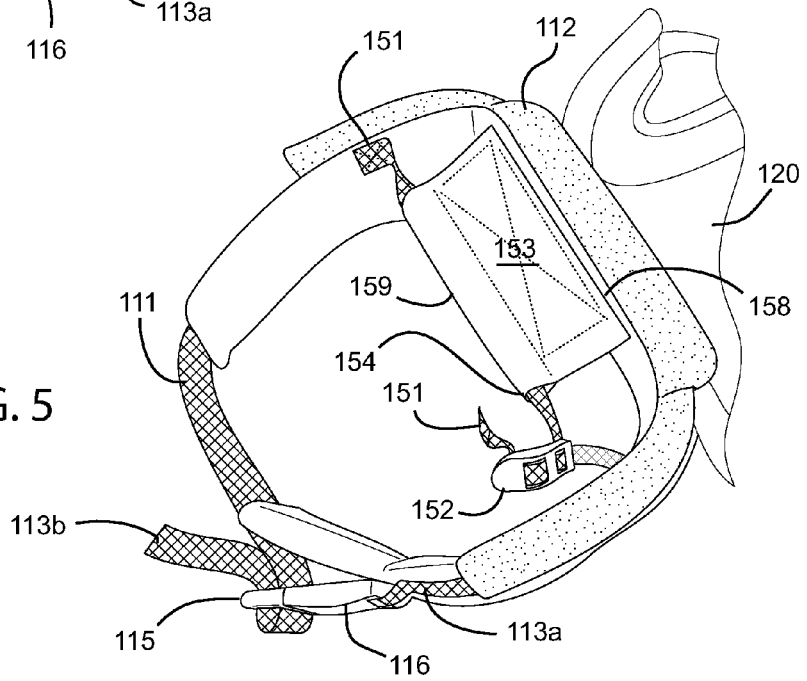
FIG. 5 shows a top view of the belt assembly and seat platform of the child carrier with the seat platform being configured in an erect configuration with the seat platform disposed in a horizontal plane extending inwardly from the upper seam toward a waist or torso of the wearer.

FIG. 5 shows a top view of the belt assembly and seat platform 153 of the child carrier with the seat platform being configured in an erect configuration with the seat platform disposed in a horizontal plane extending inwardly from the upper seam toward a waist or torso of the wearer. Here, each of the features as described in FIG. 4 are shown, however the seat platform 153 is configured in an erect configuration with the seat extending in a horizontal plane from the belt assembly toward the waist or torso of a wearer. In order to erect the seat, the wearer tightens the belt assembly adjustment strap 151 about the seat buckle 152. This adjustment results in a squeezing of the first and second side portions inwardly; thereby forming a bowed front portion of the belt assembly and a securing the seat platform in a horizontal orientation for supporting the body of the child. The seat platform 153 is shown with the adjustment strap 151 extending through a loop 154 that extends along the second side 159 of the seat platform that is opposite of the first side 158 attached to the belt assembly.

Figure 6:
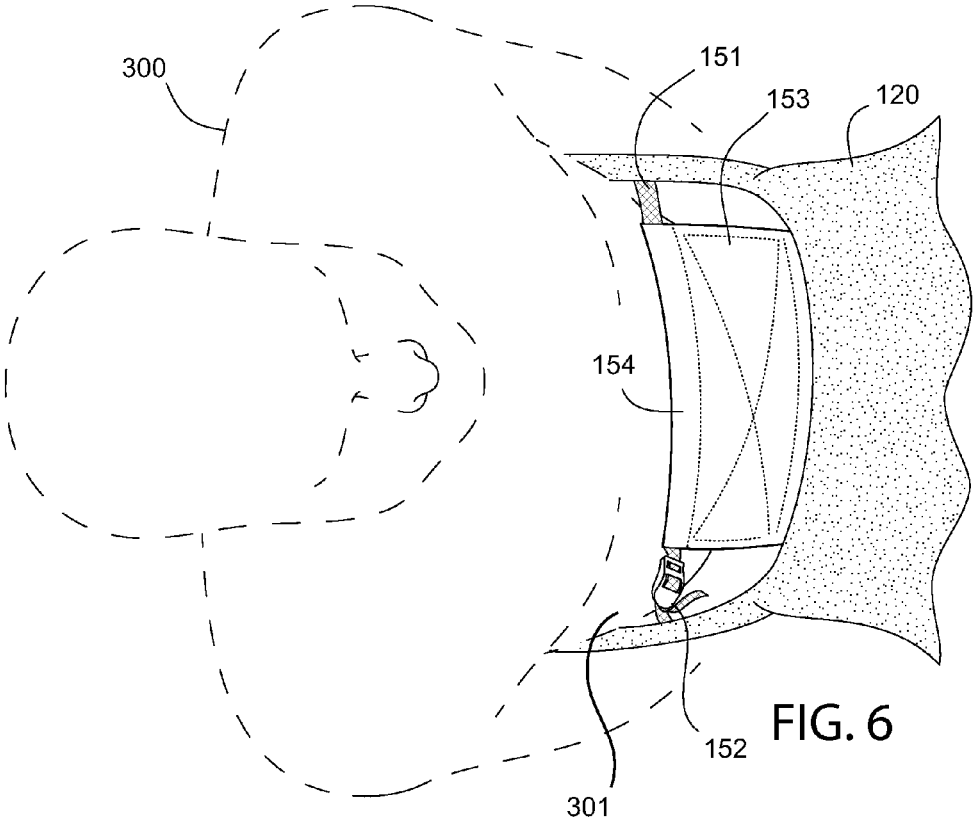
FIG. 6 further shows a top view of the seat platform in the erect configuration as viewed from above the wearer.

FIG. 6 further shows a top view of the seat platform 153 in the erect configuration as viewed from above the wearer 300. The seat platform 153 extends horizontally from the belt assembly near a junction with the pouch assembly 120 toward the waist or torso 301 of the wearer. This is accomplished by adjusting the length of the adjustment strap 151 as it extends through loop 154 of the seat platform 153 by pulling a terminal end of the adjustment strap engaged with seat buckle 152.

Figure 7:
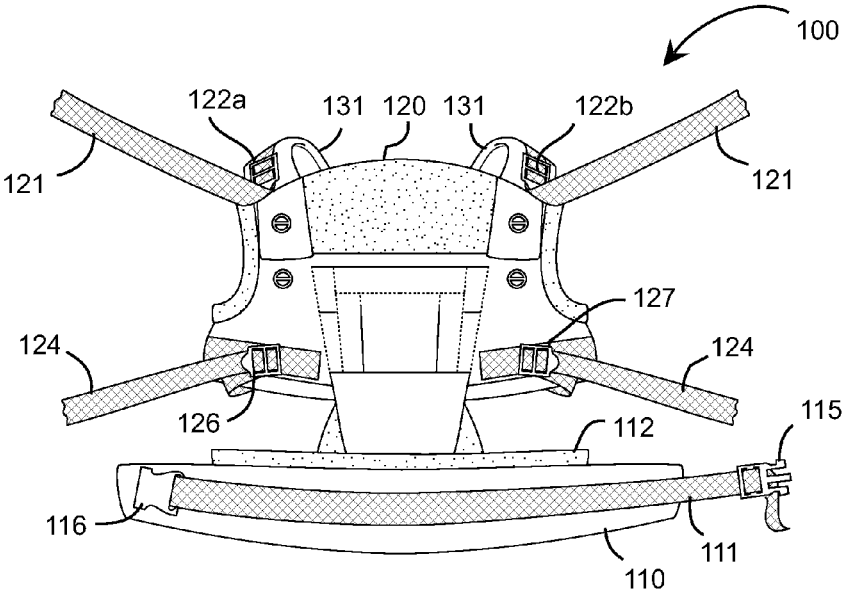
FIG. 7 shows a front view of the child carrier in a flattened configuration with the belt assembly detached.

FIG. 7 shows a front view of the child carrier 100 in a flattened configuration with the belt buckle 115 and belt buckle receiver 116 of the belt assembly being detached. The carrier comprises a belt assembly 110 including a belt 111 and a belt pad 112 attached to the belt. A belt buckle receiver 116 is fixedly disposed about a first terminal end of the belt. A belt buckle 115 is adjustable coupled to the belt at a second terminal end thereof. A pouch assembly 120 extends substantially vertically and is attached to the belt assembly; the pouch assembly is configured to secure a body of the child within the carrier. Coupled to the pouch assembly is each of a first side buckle 126 and a second side buckle 127, as shown. Each of the side buckles is configured to receive and adjustable retain a corresponding body strap 124 of the body harness. The pouch assembly further comprises a pair of upper straps 121, each of the upper straps configured on a side of the pouch assembly for engaging with a corresponding shoulder strap buckle 122*a*; 122*b* fixed to a respective shoulder strap pad 131.

Figure 8:
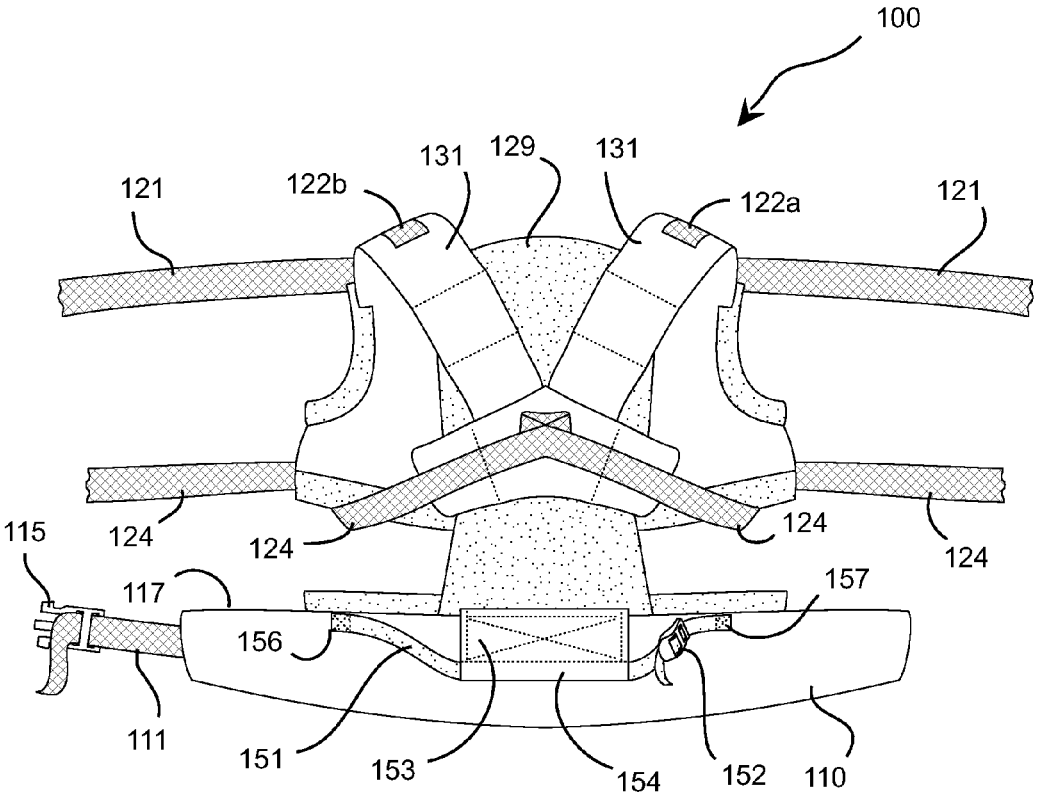
FIG. 8 shows a rear view of the child carrier in a flattened configuration with the belt assembly detached.

FIG. 8 shows a rear view of the child carrier 100 in a flattened configuration with the belt assembly detached. Continued from the above description of FIG. 7, the carrier 100 includes a belt assembly 110 as described above. The belt assembly includes a belt 111 and a belt buckle 115 adjustable coupled to the belt, as shown. The belt assembly is further characterized by a seat platform 153 attached to the belt assembly 110 along an upper periphery 117 of the belt assembly and near the front portion (at the pouch assembly). The seat platform 153 includes loop 154 extending along a length of the seat platform at the second side opposite of the first side where the seat platform is attached to the belt assembly. A belt assembly adjustment strap 151 is fixed to the belt assembly at the first side portion 156 and extends through the loop 154 of the seat platform 153 where it is further engaged with the seat buckle 152. The seat buckle is further coupled to the belt assembly 110 at the second side portion 157. The pouch assembly includes an upper end 129, and shoulder straps 131 are coupled to the pouch assembly at the upper end, such that each of the shoulder straps is configured for positioning over a left and right shoulder of the wearer, respectively. The shoulder straps 131 each include a shoulder strap buckle 122*a*; 122*b* coupled therewith. The shoulder straps 131 and body straps 124 collectively form a four point body harness which is configured to adjustable engage with corresponding buckles of the pouch assembly.

Figure 9:
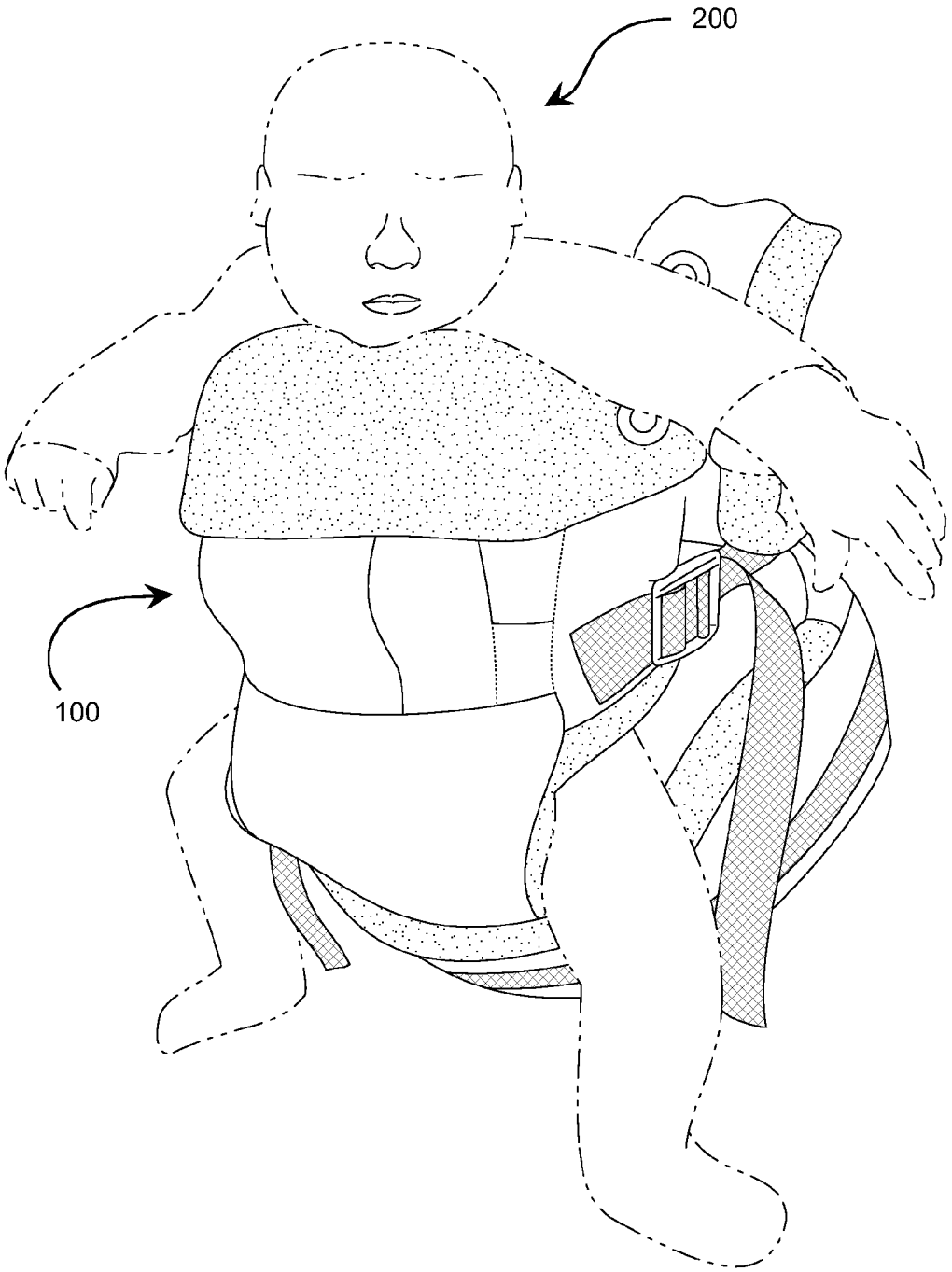
FIG. 9 shows the child carrier with a child therein facing in a direction facing away from a wearer; with the child in this position, the platform seat is deployed in the erect configuration within the carrier.

FIG. 9 shows the child carrier 100 with a child 200 therein facing in a direction facing away from a wearer; with the child in this position, the platform seat is deployed in the erect configuration within the carrier.

Figure 10A:
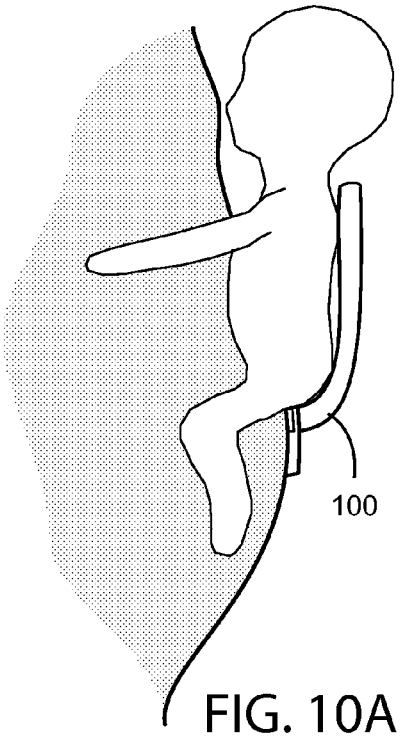
FIG. 10A shows the child carrier in a first configuration with the child facing toward the wearer.

FIG. 10A shows the child carrier 100 in a first configuration with the child facing toward the wearer.

Figure 10B:
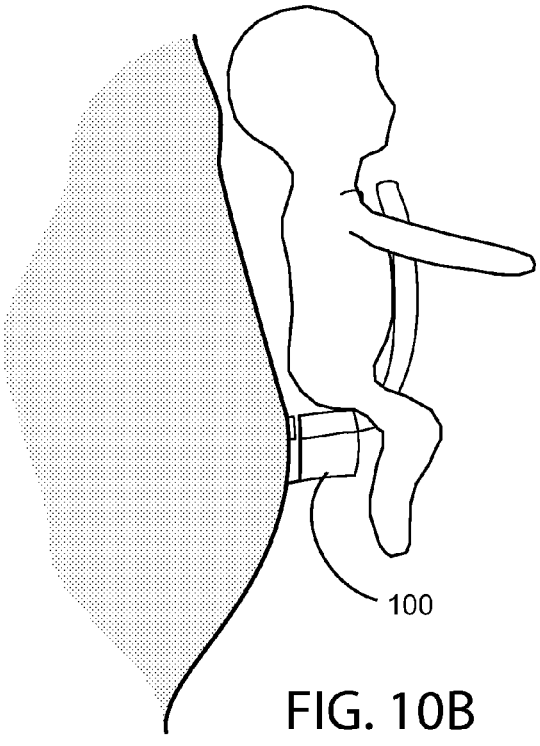
FIG. 10B shows the child carrier in a second configuration with the child facing away from the wearer, the seat is deployed and the belt pad is configured to form a bowed front portion for providing rigid structure to the seat.

FIG. 10B shows the child carrier 100 in a second configuration with the child facing away from the wearer, the seat is deployed and the belt pad is configured to form a bowed front portion for providing rigid structure to the seat.

Figure 11:
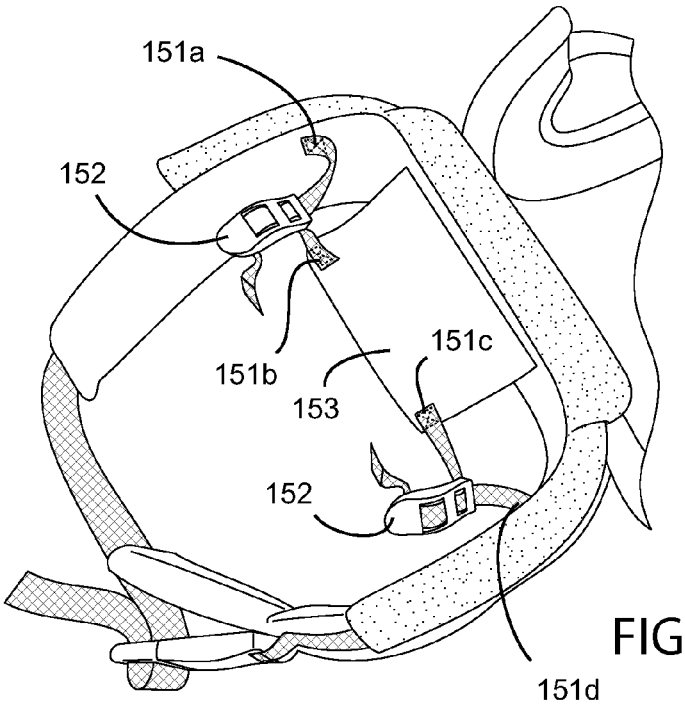
FIG. 11 shows the child carrier in accordance with another embodiment, wherein the seat comprises a first webbing strap and a second webbing strap each configured to couple with webbing straps attached to the belt assembly via buckles connected therewith.

FIG. 11 shows the child carrier in accordance with another embodiment, wherein the seat 153 comprises a first webbing strap 151*b* and a second webbing strap 151*c* each configured to couple with respective webbing straps 151*a*; 151*d* attached to the belt assembly via buckles 152 connected therewith. In this embodiment the seat does not comprise a channel or loop, but rather, includes two straps or buckles on opposing sides for tightening with the belt assembly.

Figure 12:
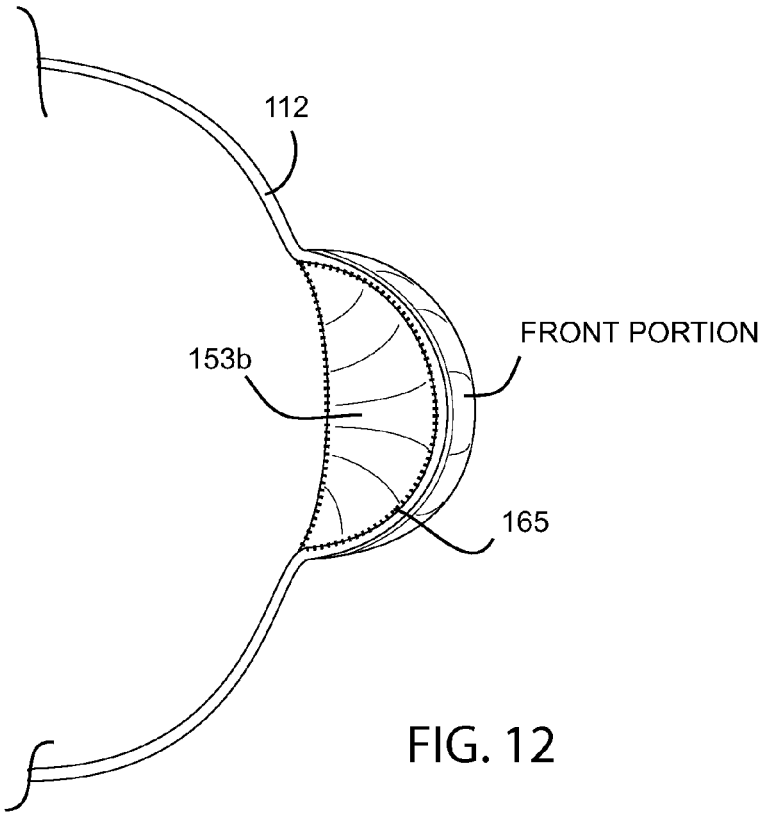
FIG. 12 shows the child carrier in accordance with another embodiment wherein the front portion of the belt assembly is bowed as a seat having a predetermined shape is attached to the belt using a zipper or similar attachment member.

FIG. 12 shows the child carrier in accordance with another embodiment wherein the front portion of the belt assembly is bowed to provide structural support to the seat 153*b*. The seat is provided with a predetermined shape configured to form the bowed front portion of the belt assembly. The seat 153*b* is attached to the belt pad 112 or other portion of the belt assembly using a zipper 165 or similar attachment member. Although a zipper 165 is shown, other similar attachment members may be similarly implemented, for example, snaps, buttons, Velcro, stitching, and the like.

Exemplary Prototype Embodiment

A prototype has been produced and tested. In a prototype embodiment developed by the named inventors, the prototype embodiment is similar to the illustrated embodiment herein, the construction of the belt assembly included a polyester fabric exterior that is approximately 0.25 mm thick; then on the inside is disposed a strip of Ethylene-vinyl acetate (EVA) foam with a density of approximately 30 g/cc and thickness of 10 mm was used; then a 10 mm layer of standard density polyurethane foam was used on the inside of the hip belt, between the EVA foam and the polyester outer layer for comfort.

The shoulder strap included a semi-structural padded shoulder harness, which generally fits in one location on the back of the wearer. There are 4 straps, one extending from each of the attachment points that allow for attachment to the front body of the child carrier. These straps can be adjusted to position the child ideally on the front of the caregiver. All adjustments are made from the front of the carrier; the wearer does not need to ever reach behind their head, neck, or back.

The straps also offer a means to allow the transition of the child into the carrier. The wearer starts by completely attaching the carrier onto their body and adjusting it how they like. Then the wearer will loosen the upper straps that attach the body of the carrier to the shoulder straps, allowing the carrier body to fall away from the body of the wearer. The wearer then brings the child to their chest, into the carry position, and then cinches up the top straps to secure the child, which can be completed with one hand.

The platform seat provides a means of providing comfort and support by extending the belt assembly outward from the wearer in a manner to create a support ledge or seat for the child. This is accomplished by attaching a belt assembly adjustment strap and integrated fabric seat platform that when tightened produces a ledge that supports the child's bottom, thighs, and back. The body portion or "pouch assembly" of a conventional child carrier attaches directly to the hip belt at the wearer's body. The resulting space for the child doesn't allow much room for the child's bottom and results in squeezing the child's bottom, legs, and crotch into a "V" shaped space. In contrast, the child carrier disclosed herein provides an ergonomic seat platform for providing comfort and improved safety to a child carried by the child carrier.

The four-point adjustable harness shown herein enables the wearer to adjust the carrier to optimally fit the wearer and the child. The four points of attachment to the shoulder harness enable the wearer to carry the child high on their body by tightening the upper straps or wear the child the low by loosening the upper straps. This height and fit adjustment can also be used optimally position the child for breast-feeding while in the carrier. The lower two attachment points (side buckles) control how close the child is to the wearer.

This adjustment should be modified to provide the most comfort to the child and will be different for inward-facing and outward-facing child configurations. Each of the adjustment points of the prototype embodiment utilize nylon webbing and ladder buckles, but other load bearing materials and adjustable connectors could be also used to produce a similar result.

In the prototype embodiment that was produced, the length of the adjustment strap is approximately 36 cm in its extended position and is tightened up to about 20 cm to produce the bottom seat configuration, but is adjustable to any length between about 15 cm and 36 cm. This results in a seat that is about 10 cm by about 20 cm.

The belt assembly is an important element of the seat in that its structure is key to the shape and integrity of the child seat. The preferred embodiment relies on a hip belt height of approximately 9 cm to provide the desired degree of stiffness. If a shorter hip belt design is desired, the stiffness of the belt would need to increase to accommodate the decrease in dimensional stiffness.

The material used in the belt assembly adjustment strap, which makes the seat, included a 1" wide nylon webbing, although any number of load bearing materials such as a cylindrical cord or wire, rope fabric strip, or thicker or thinner webbing could be used. While the prototype embodiment utilized a ladder buckle, other types of materials would require the appropriate buckle type for type of material used.

The seat configuration extends out away from the wearer about 10 cm. This distance can be increased by increasing the length of the adjustment strap. The effective seat could extend outward to provide a larger seat, which would be desirable for a larger child.

In the prototype embodiment, the shoulder strap design included a cross design. Other design configurations that would produce a similar result would include configurations with curved strap elements. While the shoulder strap design included polyester fabric with a foam interior, a single layer breathable fabric could also be used to provide comfort and breathability.

Advantages

Advantages of the instant child carrier include, without limitation, a child carrier that: (a) provides support to the child's bottom and thighs, positioning the child's legs in an ergonomically correct position which is referred as the "frog leg" or "squat spread" position; (b) enables the wearer of the carrier to first put on the carrier and then secure the child in the carrier without letting go of the child; and (c) affords the adjustability to position the carrier to optimally suite the needs of the wearer by adjusting each of the shoulder harness attach points.

While the foregoing written description of the invention enables one of ordinary skill to make and use what is considered presently to be the best mode of the invention, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

REFERENCE SIGNS LIST adult wearer (300)
belt (111)
belt assembly (110)
belt assembly adjustment strap (151)
belt buckle (115)
belt buckle assembly (114)
belt buckle receiver (116)
belt pad (112)
body harness (130)
body strap (124)
body strap pad (123)
child (200)
child carrier (100)
circumference (C1)
elongated shoulder strap pad (131)
first shoulder strap buckle (122*a*)
first side belt assembly (156)
first side buckle (126)
first side of seat platform (158)
first terminal end of the belt (113)
loop (154)
pocket (125)
pouch assembly (120)
seat buckle (152)
seat platform (153)
second shoulder strap buckle (122*b*)
second side belt assembly (157)
second side buckle (127)
second side of seat platform (159)
second terminal end of the belt (113*b*)
torso (301)
upper end of pouch assembly (129)
upper periphery (117)
upper strap (121)
zipper (165)

What is claimed is:

1. A child carrier, comprising:

a belt assembly configured to securely fasten around the waist of a wearer, the belt assembly including:

a front portion, a rear portion, a first side portion and a second side portion collectively defining a circumference of the belt assembly, and an upper periphery extending along the circumference of the belt assembly;

a pouch assembly coupled to the belt assembly and configured to receive and secure a child therein; and a body harness attached to the pouch assembly for securing the pouch assembly to the wearer;

characterized in that the child carrier further comprises:

a seat platform having a first side and a second side opposite of the first side, the seat platform attached to the belt assembly at the first side and comprising one or more loops disposed along the second side; and a belt assembly adjustment strap attached to the belt assembly at the first side portion, the belt assembly adjustment strap extending through the one or more loops of the seat platform and further coupled to a seat buckle, the seat buckle being further coupled to the belt assembly at the second side; wherein the belt assembly adjustment strap is configured to tighten the first and second sides of the belt assembly about the waist of the wearer thereby forming a bowed front portion of the belt assembly and a securing the seat platform in a horizontal orientation for supporting the body of the child;

wherein the seat platform is configured to extend between the belt assembly and the waist of the wearer.

2. The child carrier of claim 1, the body harness including: one or more shoulder straps each configured to extend over a respective shoulder of the wearer, and one or more body straps configured to secure the harness about a torso of the wearer.

3. The child carrier of claim 2, wherein each of the shoulder straps comprises: an elongated shoulder strap pad, and a shoulder strap buckle coupled to the elongated shoulder strap pad.

4. The child carrier of claim 3, wherein the pouch assembly comprises one or more upper straps, each of the upper straps attached to the pouch assembly at an upper end thereof, wherein each of the upper straps is configured to adjustably engage with a corresponding shoulder strap buckle of one of the shoulder straps.

5. The child carrier of claim 2, wherein the pouch assembly further comprises one or more side buckles coupled therewith, each of the side buckles being configured to receive and adjustably engage with one of the body straps.

6. The child carrier of claim 2, wherein each of said body straps further comprises a body strap pad for cushioning the harness about the torso of the wearer.

7. The child carrier of claim 1, wherein the belt assembly further comprises:

a belt pad configured to at least partially extend along the waist of the wearer, a belt coupled to the belt pad, a belt buckle receiver coupled to the belt at a first terminal end thereof, and a belt buckle coupled to the belt at a second terminal end opposite of the first terminal end, the belt buckle receiver and belt buckle being adapted for releasable engagement with one another and collectively forming a belt buckle assembly, wherein the belt buckle assembly is adjustable about the belt for adjusting a length of the belt for the waist of the wearer.

8. The child carrier of claim 1, wherein the pouch assembly is coupled to the belt assembly along at least a portion of the upper periphery.

9. The child carrier of claim 1, wherein dimensions of the seat platform are varied by adjusting of the belt assembly adjustment strap about the seat buckle.

10. The child carrier of claim 1 having six points of adjustment, including: a first shoulder strap buckle, a second shoulder strap buckle, a first side buckle, a second side buckle, a belt buckle assembly, and the seat buckle.

11. A child carrier, comprising:

a belt assembly configured to securely fasten around the waist of a wearer, the belt assembly including:

a front portion, a rear portion, a first side portion and a second side portion collectively defining a circumference of the belt assembly, and an upper periphery extending along the circumference of the belt assembly;

a pouch assembly coupled to the belt assembly and configured to receive and secure a child therein; and a body harness attached to the pouch assembly for securing the pouch assembly to the wearer;

characterized in that the child carrier further comprises:

a seat platform having a first side and a second side opposite of the first side, the seat platform configured to attach with at least the front portion of the belt assembly and extend between the belt assembly and the waist of the wearer; and an attachment means for coupling the seat platform about the periphery of the belt assembly along at least the front portion thereof; wherein the attached seat platform is configured to tighten the first and second sides of the belt assembly about the waist of the wearer thereby forming a bowed front portion of the belt assembly and a securing the seat platform in a horizontal orientation for supporting the body of the child.

12. The child carrier of claim 11, wherein the attachment means is a zipper.

13. The child carrier of claim 11, wherein the attachment means is one of: snaps, buttons, Velcro, or a combination thereof.

14. The child carrier of claim 11, wherein the attachment means is a stitching.

* * * * *